US006634571B2

(12) United States Patent
Shimazu

(10) Patent No.: US 6,634,571 B2
(45) Date of Patent: Oct. 21, 2003

(54) TORCH FOR THERMAL SPRAYING

(75) Inventor: Tadahiro Shimazu, Gifu (JP)

(73) Assignee: Shimazu Kogyo Yugenkaisha, Gifu (JP)

( * ) Notice: Subject to any disclaimer, the term of this patent is extended or adjusted under 35 U.S.C. 154(b) by 0 days.

(21) Appl. No.: 10/169,458

(22) PCT Filed: Jan. 29, 2001

(86) PCT No.: PCT/JP01/00589

§ 371 (c)(1),
(2), (4) Date: Jul. 1, 2002

(87) PCT Pub. No.: WO02/060593

PCT Pub. Date: Aug. 8, 2002

(65) Prior Publication Data

US 2003/0075618 A1 Apr. 24, 2003

(51) Int. Cl.[7] ..... B05B 3/16

(52) U.S. Cl. ..... 239/381; 239/225.1; 239/79; 239/83; 118/323; 118/217

(58) Field of Search ..... 239/79, 81, 83, 239/225.1, 227, 231, 237, 240, 261, 263–264, 380–381; 118/47, 317, 323

(56) References Cited

U.S. PATENT DOCUMENTS 3,013,528 A * 12/1961 Bland ..... 118/302
4,043,295 A * 8/1977 Speck et al. ..... 118/317
5,014,916 A * 5/1991 Trapani et al. ..... 239/85
5,135,166 A * 8/1992 Dietiker et al. ..... 239/8
5,275,336 A * 1/1994 Stasi et al. ..... 239/84
5,468,295 A * 11/1995 Marantz et al. ..... 118/723 DC
5,714,205 A * 2/1998 Marantz et al. ..... 427/449
5,908,670 A * 6/1999 Dunkerley et al. ..... 427/449

FOREIGN PATENT DOCUMENTS

| | | |
|---|---|---|
| JP | 56-100666 | 8/1981 |
| JP | 61-149264 | 7/1986 |
| JP | 61-149265 | 7/1986 |
| JP | 3015587 | 6/1995 |
| JP | 9-285742 | 11/1997 |

* cited by examiner

*Primary Examiner*—Timothy L. Maust
*Assistant Examiner*—Amanda Flynn
(74) *Attorney, Agent, or Firm*—Fitch, Even, Tabin & Flannery

(57) ABSTRACT

A torch for thermal spraying stored rotatably in the front portion of a nozzle and having a discharge member with a droplet passage at the center, wherein a projection is formed at the tip of the discharge member, an air jet space allowing rotating air to be blown therein is formed at the rear of the discharge member projectedly from the discharge member by integrally forming with each other a plurality of arms disposed in an air jet cylinder, and a rotating force is given to the discharge member by the air blown from an air jet port disposed on the outside of the air jet space, so as to bring the rotational speed of the discharge member into the range of 800 to 6000 rpm, whereby thermal spraying can be performed on the internal surfaces of pipes and cylinders, and the thickness of a thermal spraying film can be optimized.

4 Claims, 9 Drawing Sheets

TORCH FOR THERMAL SPRAYING

RELATED APPLICATIONS

This application is the national phase of PCT application PCT/JP01/00589, filed Jan. 29, 2001, which designated the United States but was not published in English, the disclosure of which is incorporated herein by reference.

FIELD OF THE INVENTION

The present invention relates to a thermal spraying torch, which is used in the case of carrying out a surface treatment using a thermal spray material heated and fused by a plasma forming gas or combustion gas. In particular, the present invention relates to a thermal spraying torch, which is suitable for carrying out a surface treatment with respect to an inner surface of pipes, cylinders and the like.

BACKGROUND ART

Pipes such as those for cooling medium used in boilers and power generators, pipes connecting chemical reaction equipment, pipes for delivering chemicals and carrying special materials are used under severe conditions; as a result, these pipes are easy to corrode. For this reason, the inner surface of pipes must receive a suitable surface treatment so that corrosion resistance can be improved.

Likewise, there is a great need for carrying out the surface treatment with respect to each inner surface of many cylinders 91 formed in a cylinder block 90 as shown in FIG. 12. The cylinder block 90 shown in FIG. 12 is used for an engine of automobile, for example. In this case, there is a need to reduce the entire weight of the automobile; for this reason, the cylinder block 90 is formed of a light aluminum alloy. An iron coating film must be formed on the inner surface of each cylinder 91 so that the inner surface of the cylinder can withstand repeated sliding contact of the pistons.

Plating may be used as the surface treatment with respect to the inner surface of the pipes and the cylinder 91. However, in this case, depending on the plating technique, merely a thin coating of film is formed, and further, in the case of plating a large-sized work piece, such as the cylinder block 90, considerably large plating equipment is required. In view of the above circumstances, so-called "thermal spraying technology" has attracted special interest recently as a technology capable of creating the required coating thickness comparatively easily.

However, the conventional thermal spraying technology is employed in cases where a thermal spray work piece is a flat shape as disclosed in JP 61-149264 A (Unexamined Patent Publication (Kokai) No. TOKKAISHO 61-149264) and JP 61-149265 A (Unexamined Patent Publication (Kokai) No. 61-149265), or in cases where the work piece is a large curved shape as disclosed in JP 56-100666 (Unexamined Patent Publication (Kokai) No. 56-100666). Thus, there has been almost no thermal spraying technology for carrying out a surface treatment with respect to a cylindrical inner surface such as the inner surface of pipes or the inner surface of a cylinder 91.

In view of the above circumstances, the present inventor has already proposed a thermal spraying torch, which is suitable for carrying out thermal spraying with respect to the inner surface of the pipe and the cylinder 91 in JP 5-29092 B (Examined Patent Publication (Kokoku) No. 5-29092). The thermal spraying torch disclosed in the above Publication is provided with a rotatable discharge member attached to the distal end portion, and further, the discharge member is formed with a pressure-receiving portion at the outer periphery. A gas is sprayed onto the pressure-receiving portion, and thereby, the entirety of the discharge member can be rotated. Of course, a droplet 81 is jetted from the discharge member. When being jetted, the droplet 81 is radially discharged, and thereby, thermal spraying is carried out with respect to the inner surface of the pipe and the cylinder 91 by the rotation of the discharge member and the radially discharged droplet 81.

Thereafter, the present inventor has studied the thermal spraying torch proposed in the above JP 5-29092 B (Examined Patent Publication (Kokoku) No. 5-29092). As a result, the present inventor has discovered that in the known thermal spraying torch a uniform coating 82 is difficult to form. The present inventor discovered that the discharge member does not reach a sufficiently high rotational speed (3,000 rpm or more), which he found was required for forming a uniform sprayed coating film 82 on the cylinder inner surface of a cylinder 91. The present inventor then investigated the reasons why the required rotational speed was not obtained. Although not wishing to be bound, the present inventor considers that in the thermal spraying torch proposed in JP 5-29092 B (Examined Patent Publication (Kokoku) No. 5-29092), in order to spray a gas onto the pressure receiving portion formed at the outer periphery of the discharge member, the main body positioned outside the discharge member must be formed with a first passage for supply of the gas. However, due to the design, the inner diameter of the first passage cannot be set too large, and thereby, the amount of gas supplied to the outer periphery of the discharge member is limited. As a result, the discharge member cannot attain a satisfactory, desired high rotational speed, which denies the regular forming of a uniform sprayed coating film 82.

Of course, in cases where a material such as zinc having a relatively low melting point is used as a thermal spray material, the high rotational speed as described above is not required. Further, in order to prevent mechanical damage to this type of rotary torch, there are some cases where it is desired that the rotational speed is as low as possible.

Further, the present inventor has conducted various studies as to determine the setting of the rotational speed of the discharge member in the ranges of 800 to 6,000 rpm and as a result, the present invention has been made.

SUMMARY OF THE INVENTION

In the Summary and in the "Best Mode for Carrying out the Invention" like reference numerals are used in describing constituent components or process steps included in first and second aspects of the present invention.

An object of the present invention is to provide a thermal spraying torch 100, which can set a rotational speed of discharge member for radially discharging droplets 81 to a range from 800 to 6,000 rpm, and can carry out thermal spraying with respect to the inner surface of a pipe or a cylinder 91.

Another object of the present invention is to provide a thermal spraying torch 100, which can set a rotational speed of discharge member for radially discharging a droplet(s) 81 to a suitable value, e.g., 3,000 rpm within a range from 800 to 6,000 rpm, and can carry out thermal spraying with respect to the inner surface of a pipe or a cylinder 91, and further, can protect bearings supporting the discharge member so that high durability can be obtained.

In order to achieve the above objects, according to a first aspect of the invention, the present invention provides a thermal spraying torch 100 that is capable of successively supplying a thermal spray material 80, which can be heated and fused by a plasma forming gas formed by an arc generated between electrodes contained in an outer cylinder 10 or by a combustion gas supplied passing through an outer cylinder 10 and burned under high temperature state, and spraying the thermal spray material 80 via a nozzle 40 using the plasma forming gas or the combustion gas so that a droplet(s) 81 can be formed. The thermal spraying torch 100 further includes a rotating discharge member 60, which is contained at a forward portion of the nozzle 40 and has a droplet passage 61 for the droplet(s) 81 at the center so that the droplet(s) 81 can be jetted together with the plasma forming gas or the combustion gas. The discharge member 60 is formed with a projection 63, which changes a discharge direction of a droplet(s) 81 at the center of the distal end portion, and is formed integrally with a plurality of arm members 65, which are projected from the discharge member 60 and arranged in an air jet cylinder 50 contained in the outer cylinder 10 at the rear end, whereby an air jet space 66 for jetting a rotation air is formed, and a rotational force can be given to the discharge member 60 by jetting air from an air jet port 53 of the air jet cylinder 50 arranged outside the air jet space 66.

That is, the thermal spraying torch 100 described in the first aspect of the invention, can include the same discharge member 60 as that of the thermal spraying torch proposed already by the present inventor in the above JP 5-29092 B (Examined Patent Publication (Kokoku) No. 5-29092). The discharge member 60 is formed integrally with a plurality of arm members 65, which are projected from the discharge member 60 and arranged in an air jet cylinder 50 contained in the outer cylinder 10 at the rear end. A plurality of arm members 65 is formed at the rear end of the discharge member 60, and thereby, the air jet space 66 for jetting a rotation air is formed at the rear end of the discharge member 60 and in the air jet cylinder 50 contained in the outer cylinder 10.

Therefore, as shown in FIG. 2 to FIG. 4 and FIG. 8, in the thermal spraying torch 100, the entire periphery of the air jet cylinder 50 covering all arm members 65 of the discharge member 60 is formed with the rotation air passage 13. By doing so, it is possible to jet a gas (usually, compressed air or incombustible gas) in an amount sufficient to rotate the discharge member 60 at high speed from many air jet ports 53 formed in the air jet cylinder 50 toward each arm member 65.

The thermal spraying torch 100 according to an embodiment shown in FIG. 2 to FIG. 4 is a torch of a so-called "gas wire flame spraying" type thermal spraying equipment. As shown in FIG. 4, the thermal spray material 80 is fused by the combustion gas supplied through the outer cylinder 10 and burning under high temperature state. Thereafter, the fused thermal spray material 80 is sprayed by the combustion gas and the above gas such as air after a rotational force is given to the discharge member 60, and thereby, the droplet 81 can be formed.

As shown in FIG. 3, a fuel gas and an auxiliary gas such as oxygen are supplied to a fuel gas passage 11 and an auxiliary gas passage 12 formed in the thermal spraying torch 100 via a fuel gas supply tube 11*a* and an auxiliary gas supply tube 12*a* connected individually to a support member 20 constituting the thermal spraying torch 100. Then, the fuel gas and the auxiliary gas are mixed in a mixing chamber 36 formed by a tributary member 30. The fuel gas and the auxiliary gas thus mixed are supplied to a mixed gas hole 43 formed in a nozzle 40 via a mixed gas hole 34 of the tributary member 30, and then, are jetted from the distal end of each mixed gas hole 43 into the droplet passage 61 of the discharge member 60. In this case, the mixed gas is ignited by an external igniter, and is used as high temperature combustion gas capable of fusing the thermal spray material 80.

The thermal spray material 80 has a line-like form made of a steel material, for example. In particular, as shown in FIG. 3, the thermal spray material 80 is supplied by an external equipment of the thermal spraying torch 100 via a center hole 22 of the support member 20, a center hole 32 of the tributary member 30 and a center hole 42 of the nozzle 40, which are mutually connected. In this case, the thermal spray material 80 is supplied so as to successively project from the distal end of the nozzle 40, that is, from the flame 15 shown in FIG. 4 at a constant speed.

Additionally, in the thermal spraying torch 100, the discharge member 60 is rotated at a high speed, and at the distal end of the nozzle 40, the thermal spray material 80 is fused by the combustion gas so that droplets 81 can be formed. In this case, as shown in FIG. 4, the air rotating the discharge member 60 passes through an air passage 62 of the discharge member 60 at high speed, and further, the discharge member 60 is formed with a projection 63 for bending the direction of the air passage 62 at angle of about 100 degree at the distal end. Therefore, the droplets 81 can be radially jetted as shown by a dotted line of FIG. 1 and FIG. 4.

In the thermal spraying torch 100, the droplets 81 can be formed from a thermal spray material 80 by a plasma forming gas formed using an electric arc technique. In such a case, the above nozzle 40 or the thermal spray material 80 passing through it is used as a negative electrode, and the discharge member 60 is used as a positive electrode. In this case, in place of the fuel gas, the plasma forming gas may be passed through the fuel gas passage 11 and the auxiliary gas passage 12.

Therefore, the thermal spraying torch 100 is inserted into each cylinder 91 of a cylinder block 90 at a constant speed as shown in FIG. 12, and thereby, a sprayed coating film 82 as shown can be formed on the inner surface of each piper or cylinder 91. Of course, since the discharge member 60 is rotated at a high speed, a sprayed coating film 82 having a uniform thickness (in this embodiment, about 0.1 to 0.3 mm) is formed on the cylindrical inner surface of each pipe or cylinder 91.

Further, in order to achieve the above objects, according to a second aspect of the invention, the present invention provides a thermal spraying torch 100, successively supplying a thermal spray material 80 heated and fused by a plasma forming gas formed using an arc between electrodes contained in an outer cylinder 10, or by a combustion gas supplied passing through the outer cylinder 10 and burned under high temperature state, and spraying the thermal spray material 80 via a nozzle 40 by the forming gas or the combustion gas so that droplets 81 can be formed, and further, including a rotatable discharge member 60, which is contained at a forward portion of the nozzle 40 and has a droplet passage 61 for the droplets 81 at the center so that the droplets (81) can be jetted together with the forming gas or the combustion gas, wherein the discharge member 60 is formed with a projection 63, which changes a discharge direction of a droplet(s) 81 at the center of the distal end portion, and is formed integrally with a plurality of arm members 65, which are projected from the discharge member 60 and arranged in an air jet cylinder 50 contained in the outer cylinder 10 at the rear end, thereby forming an air jet space 66 for jetting a rotation air and a plurality of retractable support spaces 67 opened in a direction perpendicular to the axial line, a rotational force is given to the discharge member 60 by air jetted from an air jet port 53 of the air jet cylinder 50 arranged outside an air jet space 66, and a friction block 70 is movably contained in each retractable support space 67, and an outer surface 71 of each friction block 70 is abutted against the air jet cylinder 50 so that the rotational force is set to a predetermined value or less.

The thermal spraying torch 100 according to a second aspect to the invention may generally have the same basic structure as a thermal spraying torch 100 according to a first aspect of the invention. However, the thermal spraying torch 100 according to a second aspect of the invention differs from the thermal spraying torch 100 according to the first aspect in the following points. More specifically, the discharge member 60 is formed integrally with the plurality of arm members 65 at the rear end. By doing so, as shown in FIG. 7, the air jet space 66 for jetting rotating air and the plurality of retractable support spaces 67 opened in a direction perpendicular to the axial line are formed, and the movable friction block 70 is contained in each retractable support space 67. The thermal spraying torch 100 according to the second aspect is the same as the above-described thermal spraying torch 100 according to the first aspect in that the retractable support spaces 67 are formed, and the friction block 70 is movably contained in each retractable support space 67; therefore, a further detailed explanation may be omitted.

In this embodiment, as shown in FIG. 7, one air jet space 66 for jetting a rotation air and three retractable support spaces 67 opened in a direction perpendicular to the axial line of the discharge member 60 are formed. Further, the air jet space 66 and the retractable support spaces 67 are arranged so as to form the cross-shaped letter. Three removable friction blocks 70 arranged as shown in FIG. 9 are contained in the three retractable support spaces 67, respectively. By doing so, each friction block 70 is abutted against the inner surface of the air jet cylinder 50 positioned directly outside the retractable support spaces 67 by a centrifugal force when the discharge member 60 is rotated at a high speed. In this case, each friction block 70 is contained in each retractable support space 67 so that an outer peripheral surface 71 of the friction block 70 shown in FIG. 9 and FIG. 10 is positioned toward the outside.

As a result, in the thermal spraying torch 100 according to a second aspect, the outer peripheral surface 71 of each friction block 70 is abutted against the inner surface of the air jet cylinder 50 by a centrifugal force when the discharge member 60 is rotated at a high speed. Therefore, a frictional force is generated between the outer peripheral surface 71 of each friction block 70 rotating together with the discharge member 60 and the inner surface of the air jet cylinder 50, which is not rotated because it is provided on the outer cylinder 10. By the frictional force, the rotational force of the discharge member 60 is set at a predetermined value or less.

The frictional force by the friction blocks 70 may be adjusted by making various changes to the number of the retractable support spaces 67, the number of friction blocks 70 contained in these retractable support spaces 67 (e.g., contained in only two of three retractable support spaces 67), and a mass (weight) of the friction block 70. Basically, the total mass of each friction block 70 is changed, or a coefficient of friction between these friction blocks 70 and the air jet cylinder 50 contacting with the blocks are changed.

Therefore, in the thermal spraying torch 100 according to a second aspect of the invention, the brake is applied by a centrifugal force when the discharge member 60 is rotated at a high speed, that is, by the friction blocks 70 contained in the retractable support spaces 67. By doing so, the discharge member 60 enables rotation at a speed no higher than necessary; therefore, damage to each rotatable bearing 64 supporting the discharge member 60 to the outer cylinder 10 and a distal opening 14 of the outer cylinder 10 is avoided. As a result, it is possible to provide a thermal spraying torch having high durability.

A thermal spraying process using a present thermal spraying torch is also provided.

BEST MODE FOR CARRYING OUT THE INVENTION

Best mode for carrying out the present invention will be described below with reference to the accompanying drawings. In FIG. 1 to FIG. 4, there is a thermal spraying torch 100 according to one embodiment of the present invention. The thermal spraying torch 100 of this embodiment is a so-called wire flame spraying type such that thermal spray material 80 formed as a wire rod is fused by heat obtained by burning a mixed gas of fuel gas and auxiliary gas such as oxygen, and thereby, droplets 81 are obtained. In this case, of course, metal powder may be used as the thermal spray material 80, and the thermal spray material 80 may be fused by plasma forming gas in an arc.

Further, the thermal spraying torch 100 of this embodiment substantially includes both inventions described in the first and second aspects; therefore, the thermal spraying torch 100 of this embodiment will mainly be described below.

Figure 1:
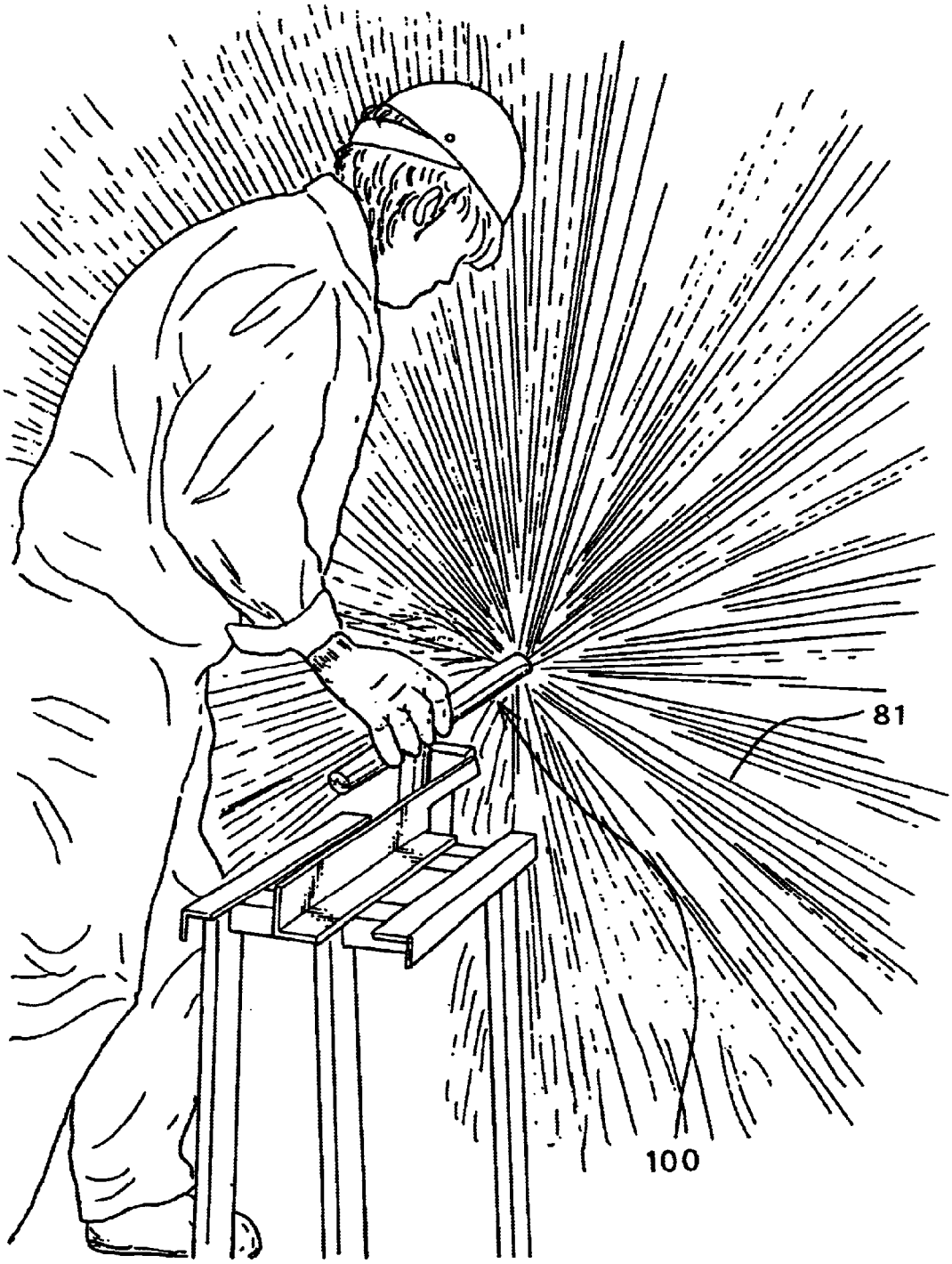
FIG. 1 is a perspective view showing the carrying out of a thermal spraying experiment by a thermal spraying torch 100 according to the present invention.
Figure 2:
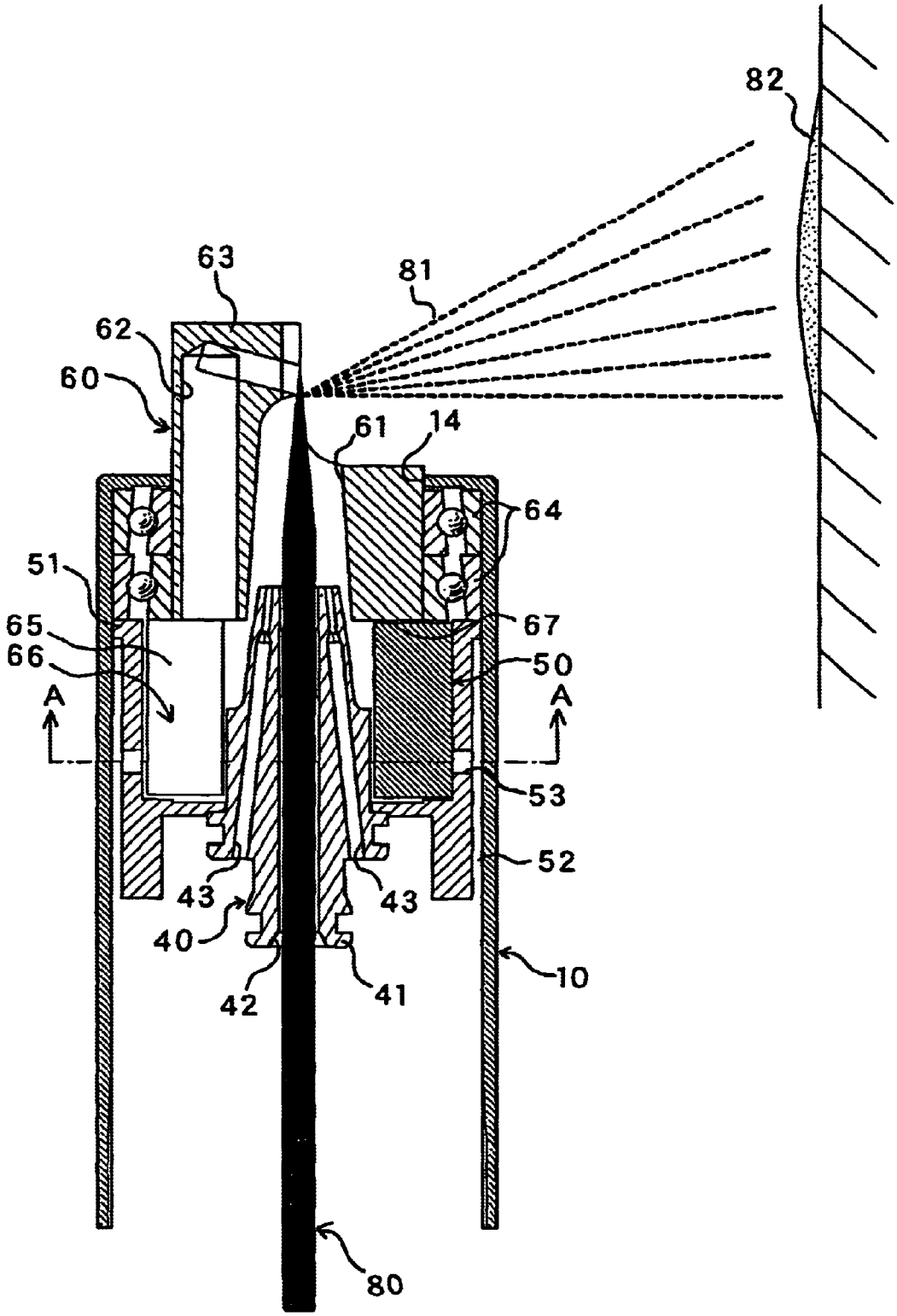
FIG. 2 is a partial sectional view showing the state that a sprayed coating film 82 is formed on the surface of work piece by the thermal spraying torch 100.
Figure 3:
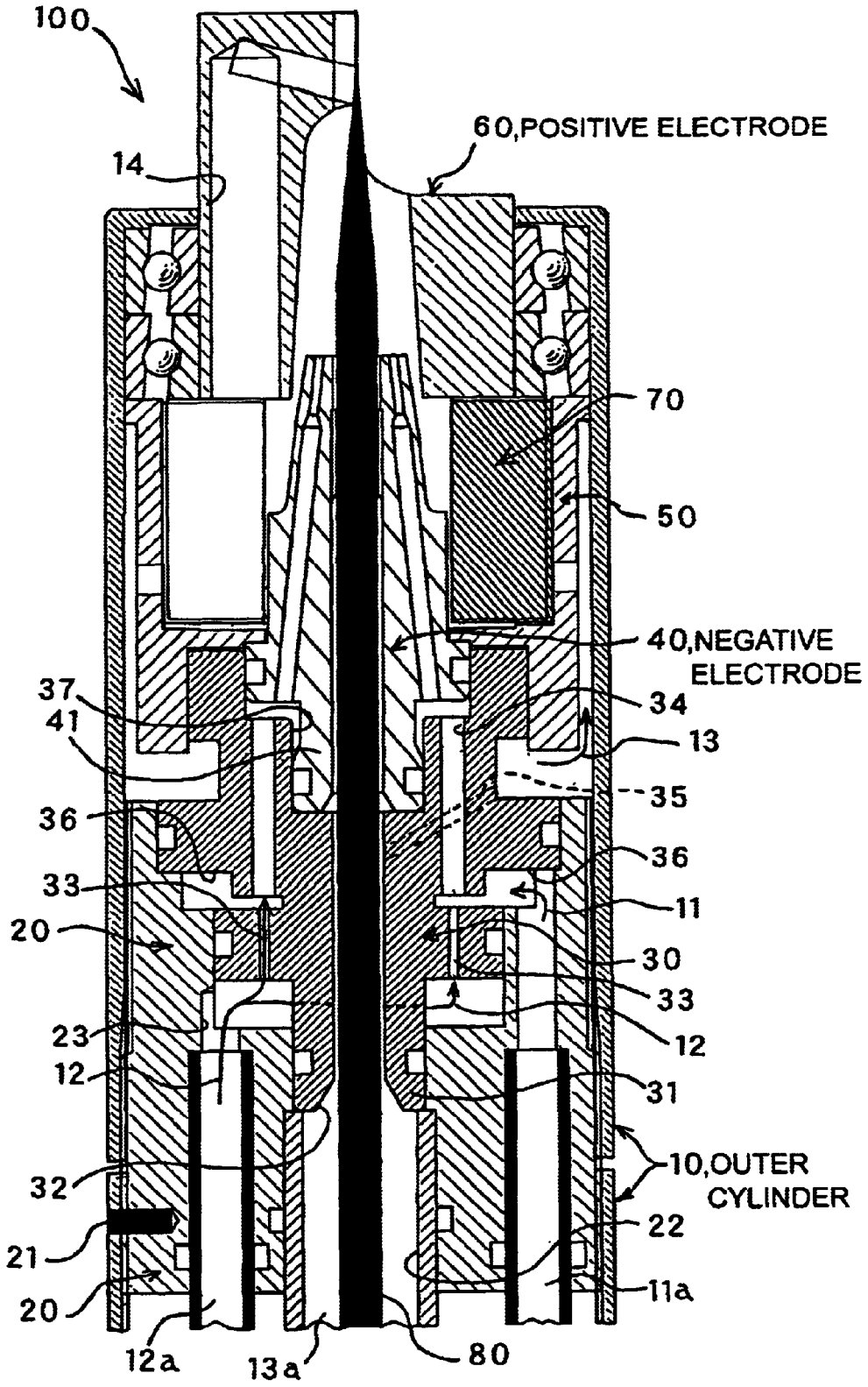
FIG. 3 is an enlarged sectional view showing principal parts of the thermal spraying torch 100.
Figure 4:
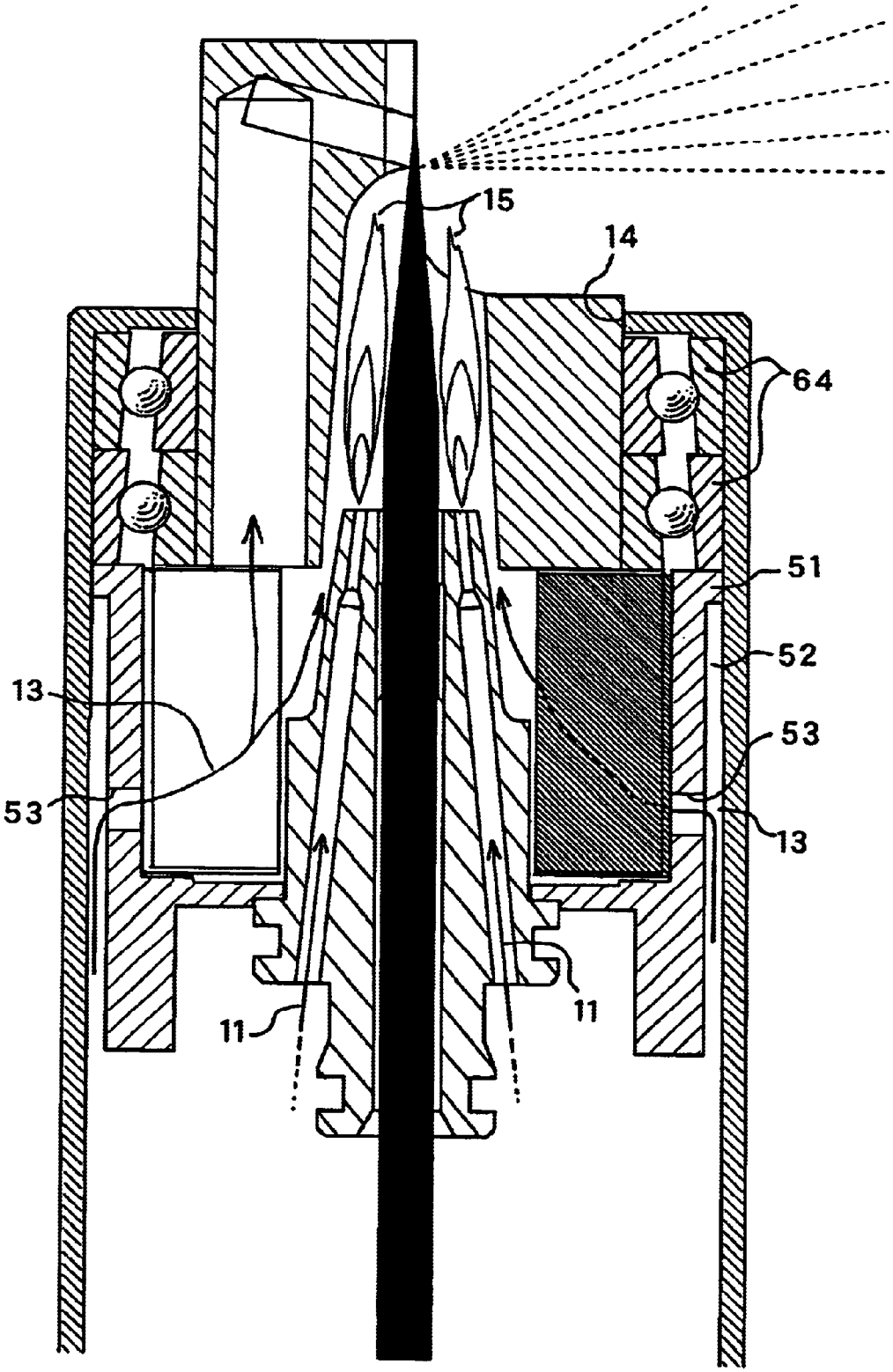
FIG. 4 is a partially enlarged sectional view showing the state that a flame 15 is formed by the thermal spraying torch 100, and a droplet 81 is sprayed by an air from a rotary air passage 13.

As shown in FIG. 2 to FIG. 4, the thermal spraying torch 100 includes a support member 20, a tributary member 30, a nozzle 40, an air jet cylinder 50 and a discharge member 60, in succession from the lower side of FIG. 3 in an outer cylinder 10 forming the contour of the torch. More specifically, the support member 20 is connected with a fuel gas supply tube 11*a*, an auxiliary gas supply tube 12*a* and an air supply tube 13*a*. The tributary member 30 is connected to the upper end of the center hole 22 of the support member 20 by a support projection 31. The nozzle 40 is connected to a support hole 37 of the tributary member 30 by a support projection 41. The air jet cylinder 50 is arranged on the upper periphery of the tributary member 30 so as to surround the nozzle 40. The discharge member 60 is arranged so as to surround the distal end of the nozzle 40. These support member 20, tributary member 30, nozzle 40 and discharge member 60 are formed with coaxially aligned center holes 22, 32, 42 and droplet passage 61, respectively, as shown in FIG. 1 and FIG. 3. The thermal spray material 80 painted by black in FIG. 2 to FIG. 4 is supplied from the lower side of figures into the center holes 22, 32, 42 and the droplet passage 61 at a constant speed.

The outer cylinder 10 containing the above-mentioned members is formed with a fuel gas passage 11, an auxiliary gas passage 12 and a rotating air passage 13. In this case, these fuel gas passage 11, auxiliary gas passage 12 and rotating air passage 13 are formed by assembling the support member 20, the tributary member 30, the nozzle 40 and the discharge member 60. First, the support member 20, the tributary member 30, the nozzle 40 and the discharge member 60 will be described below.

The support member 20 is connected to the upper opening of the outer cylinder 10 shown on the lower side of FIG. 3, and is fixed by a fixing pin 21. The support member 20 is formed with a screw portion at the upper end of the outer periphery. The screw portion is screwed with another outer cylinder 10 shown in FIG. 2, that is, an outer cylinder having an opening 14 at its distal end at the center of the upper end, different from the outer cylinder 10 shown in the lower side of the FIG. 3. Further, the support member 20 is formed with a recess, which forms an auxiliary gas chamber 23 when the tributary member 30 is assembled to the support member 20, at the middle portion. The recess, that is, the auxiliary gas chamber 23 communicates with the auxiliary gas tube 12*a* connected to the lower end of the support member 20.

The center hole 22 of the support member 20 is connected with the air supply tube 13*a* as shown in FIG. 3, and a compressed air or incombustible gas for rotation is supplied into the air supply tube 13*a* while the thermal spray material 80 being supplied thereto. Further, the support member 20 is connected with the fuel gas supply tube 11*a* and the auxiliary gas supply tube 12*a*. Each distal end of the gas supply tube 11*a* and the auxiliary gas supply tube 12*a* forms the fuel gas passage 11 and the auxiliary gas passage 12 in the support member 20 as shown in FIG. 3.

The support projection 31 of the tributary member 30 is inserted into the upper end of the center hole 22 of the support member 20, and thereby, the tributary member 30 is assembled. The tributary member 30 is formed with the center hole 32 to which the thermal spray material 80 is supplied together with a rotation air at the center portion, and further, is formed with many auxiliary gas holes 33 at the position slightly far from the center hole 32. Each auxiliary gas hole 33 connects with the above auxiliary gas chamber 23 so as to form the auxiliary gas passage 12, and its distal end is connected to a mixing chamber 36. A part of the mixing chamber 36 communicates with the above fuel gas passage 11, and a fuel gas supplied via the fuel gas passage 11 and an auxiliary gas such as oxygen supplied from the auxiliary gas hole 33 are mixed therein. A mixed gas is supplied to the upper nozzle 40 side via each mixed gas hole 34 formed on the upper portion of the tributary member 30.

The outer periphery on the upper portion of the tributary member 30 is connected to the lower end opening of the air jet cylinder 50 in a state that a clearance forming the rotation air passage 13 remains. The rotation air passage 13 thus formed connects with the center hole 32 of the tributary member 30 by an air hole 35 shown by a dotted line in FIG. 3. Further, the tributary member 30 is formed with the support hole 37 on the center of its upper portion, and the support projection 41 of the nozzle 40 is inserted into the support hole 37.

The nozzle 40 is connected to the tributary member 30 via the support hole 37, and its center thereof is formed with a center hole 42 to which the thermal spray material 80 or compressed air is supplied. Further, the nozzle 40 is formed with a mixed gas hole 43 for passing a mixed gas supplied from the mixed gas hole 34 of the tributary member 30. Further, the nozzle 40 is supported by the air jet cylinder 50 described later at the outer periphery of its lower portion.

Figure 8:
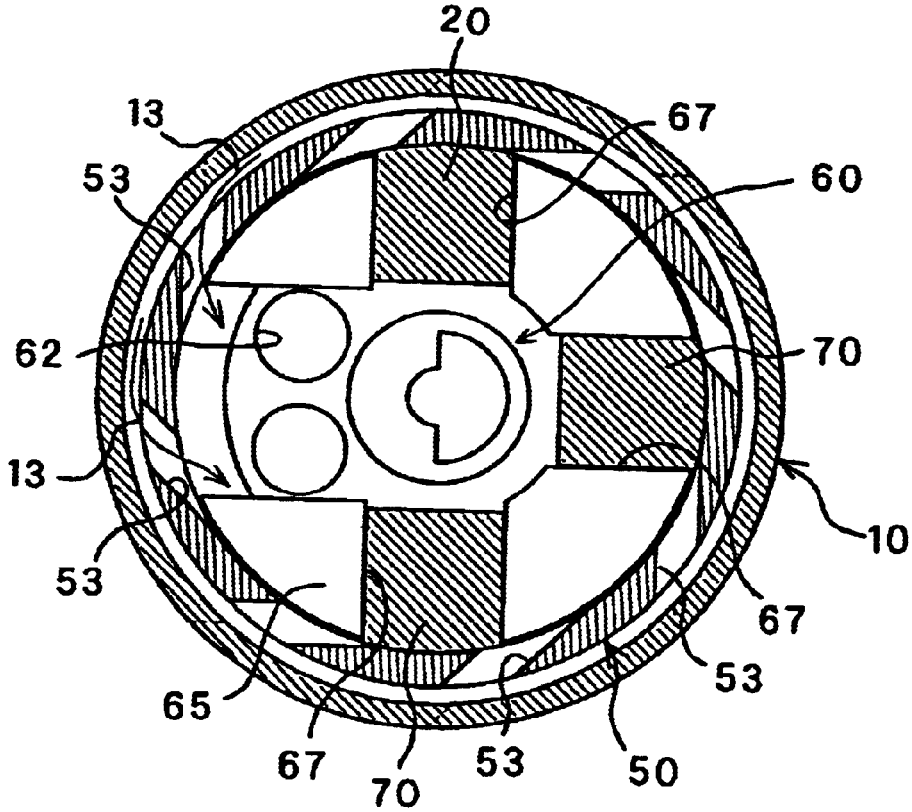
FIG. 8 is a transverse sectional bottom view taken along the line A—A of FIG. 2.

As shown in FIG. 4 and FIG. 8, the air jet cylinder 50 is a cylinder, which is arranged directly inside the outer cylinder 10 via a rotation air chamber 52 forming the rotation air passage 13. Further, the air jet cylinder 50 is abutted against the inner surface of the outer cylinder 10 by an air stopper flange 51 formed on the upper side of FIG. 4. Further, the air jet cylinder 50 is formed with many air jet ports 53, which are slantingly formed so that the direction of the rotation air passage 13 becomes a direction shown by the arrow of FIG. 4.

Figure 5:
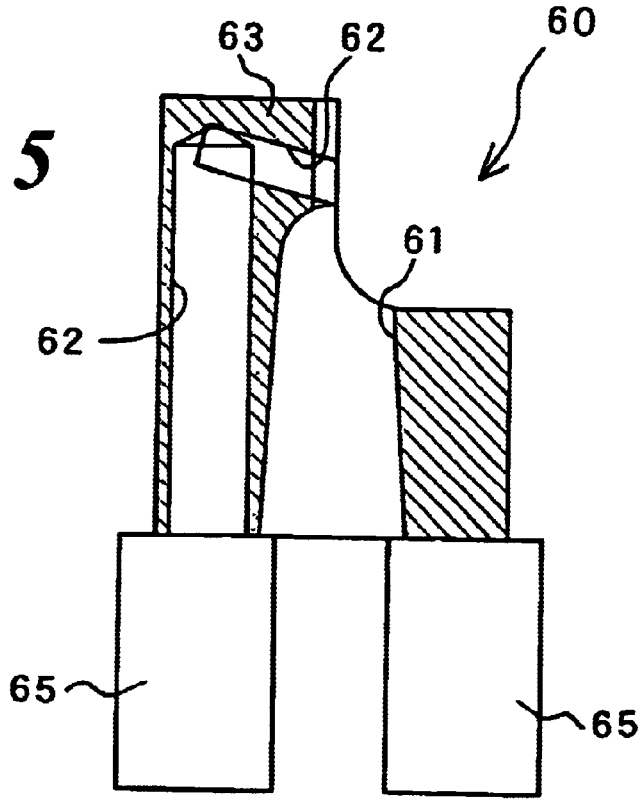
FIG. 5 is a longitudinally enlarged sectional side view showing a discharge member 60 constituting the thermal spraying torch 100.
Figure 6:
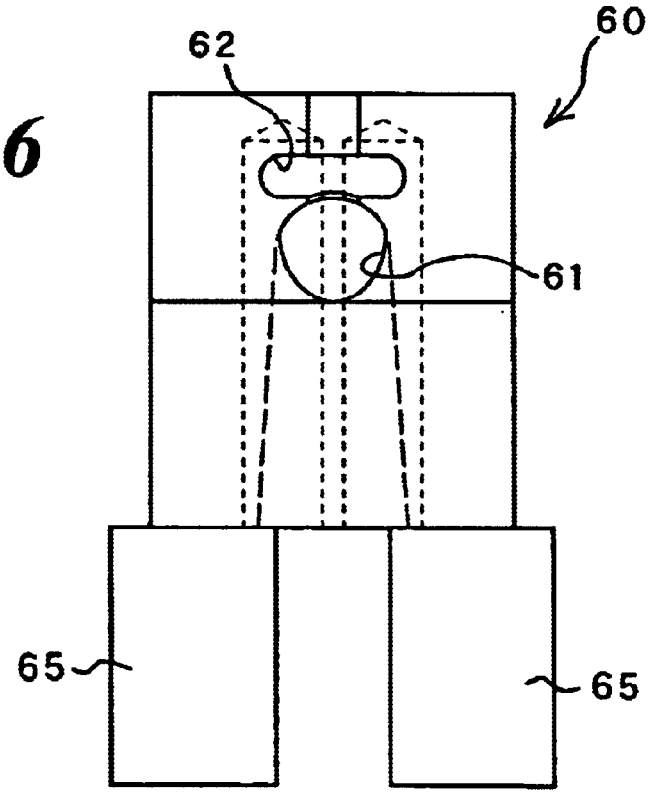
FIG. 6 is a front view showing the discharge member 60.

As shown in FIG. 2, FIG. 5 and FIG. 6, the discharge member 60 is formed with a droplet passage 61 for forming droplets 81 at the center of the distal end portion, a projection 63 for changing a discharge direction of the droplets 81, and an air passage 62 connected into the projection 63. Further, the upper end portion of the discharge member 60 is inserted into the distal opening 14 formed in the outer cylinder 10. Further, the discharge member 60 is supported to the outer cylinder 10 so that it can be freely rotated by a bearing 64 interposed between the air stopper flange 51 of the air jet cylinder 50 and the outer cylinder 10 as shown in FIG. 4.

Figure 7:
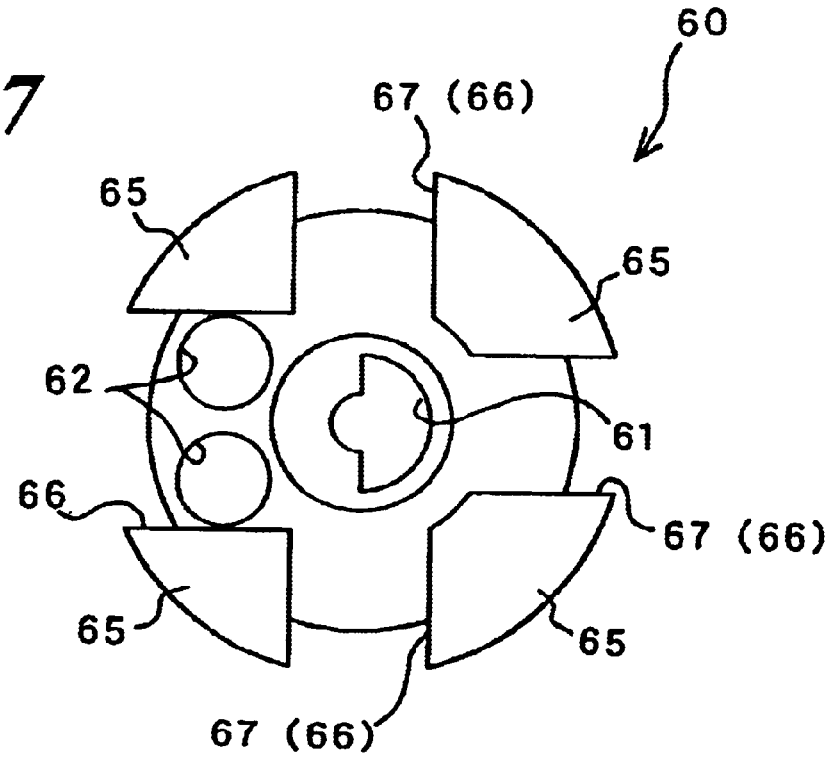
FIG. 7 is a bottom view showing the discharge member 60.

Moreover, the discharge member 60 is formed integrally with a plurality of arm members 65 (four in this embodiment), which are projected from the discharge member 60, and arranged in the air jet cylinder 50 contained in the outer cylinder 10 at the read end. As shown in FIG. 7 and FIG. 8, an air jet space 66 for jetting rotation air and a plurality of retractable support spaces 67 are formed by the arm members 65. In this case, the retractable support spaces 67 are opened in a direction perpendicular to the axial line.

The above air jet cylinder 50 is arranged outside the air jet space 66. As shown in FIG. 8, the air jetted from the air jet port 53 of the air jet cylinder 50 is sprayed onto the arm members 65 forming the air jet spaces 66, and thereby, a rotational force is given to the discharge member 60.

Figure 9:
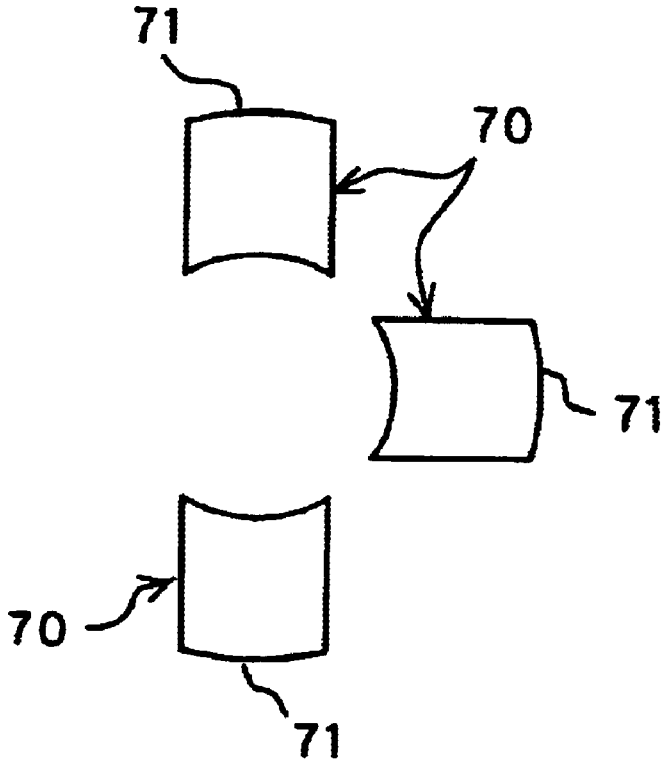
FIG. 9 is a top plan view showing a plurality of friction blocks 70 used in a thermal spraying torch 100 according to a second aspect of the invention.
Figure 10:
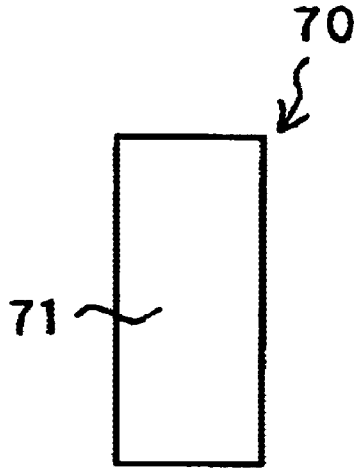
FIG. 10 is a front view showing the friction block 70.
Figure 11:
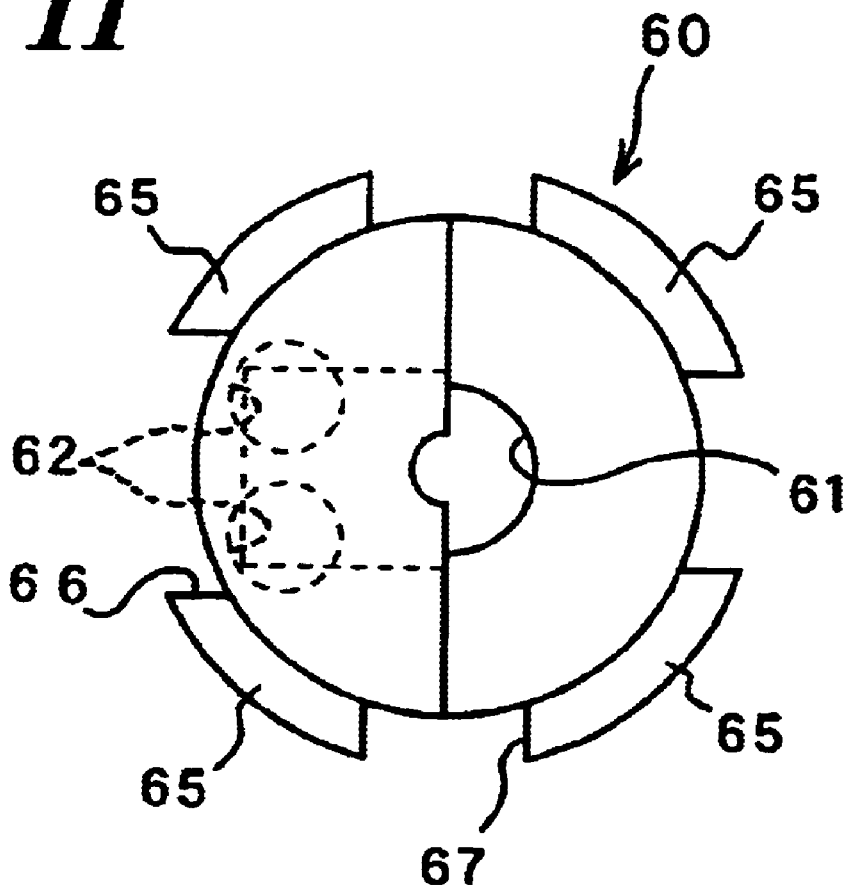
FIG. 11 is an enlarged plan view showing the discharge member 60.
Figure 12:
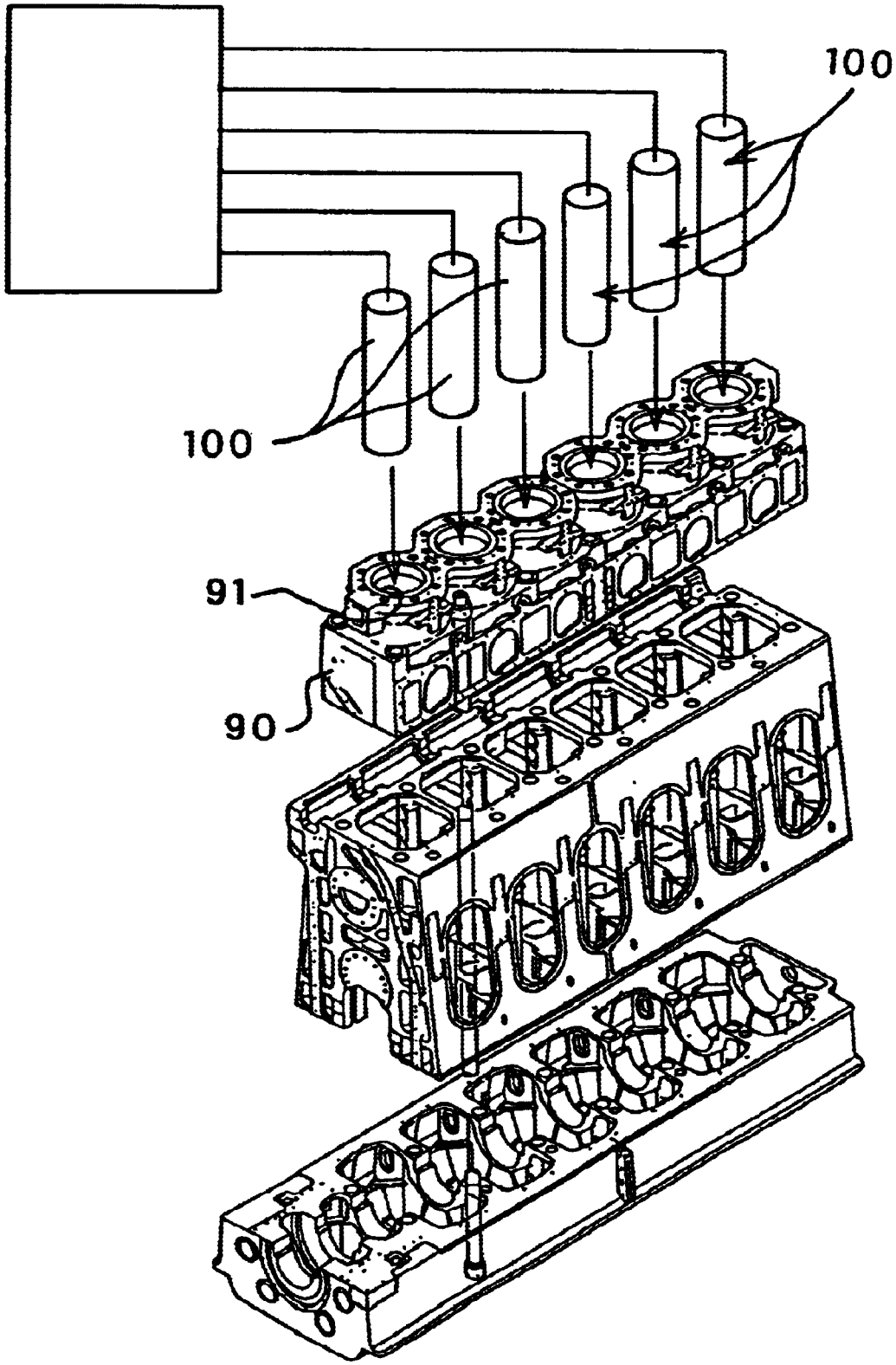
FIG. 12 is a perspective view showing a state that a plurality of thermal spraying torches 100 are simultaneously operated so that a surface treatment is carried out with respect to each inner surface of a plurality of cylinders 91.

As shown in FIG. 4 and FIG. 8, a friction block 70 is movably contained in each retractable support spaces 67 (In this embodiment, three portions in total, i.e., up and down, and right portions). As shown in FIG. 9 and FIG. 10, each friction block 70 is formed with an outer peripheral surface 71, which slides in contact with the inner surface of the air jet cylinder 50 so as to generate a frictional force.

In the thermal spraying torch 100 of this embodiment, a hardened (quench) steel tube or pipe is used as the material constituting the air jet cylinder 50, and has an inner diameter of 30 to 32 mm. On the other hand so-called bronze is used as the material constituting the frictional block 70. The friction block 70 is formed so that the area of the outer peripheral surface 71 can be set to about 1.0 to 2.0 $cm^2$, and has a weight of 5 to 10 grams. In addition, various materials such as BAKELITE™ synthetic resin, tungsten and aluminum alloy may be applicable as the friction block 70.

A friction block 70 having the size and weight as described above is formed, and the rotational speed of the discharge member 60 can therefore be set to about 3,000 rpm.

According to the present invention, in the thermal spraying torch 100 having the above structure, the rotational speed of the discharge member 60 for radially discharging the droplet 81 can be set to a range from 800 to 6,000 rpm. Further, thermal spraying is carried out with respect to the inner surface of the pipes or cylinder 91 so that a uniform sprayed coating film 82 can be formed. In particular, in the thermal spraying torch 100, the rotational speed of the discharge member 60 is set to a range from 800 to 6,000 rpm. Therefore, various materials such as zinc having a low melting point and steel having a relatively high melting point can be employed as the thermal spray material 80, and various sprayed coatings 82 can be formed.

Moreover, in a thermal spraying torch 100 according to a second aspect, the discharge member 60 is formed with the projection 63 for changing the discharge direction of the droplets 81 at the center of the distal end portion. Further, the discharge member 60 is formed integrally with the plurality of arm members 65, which are projected from the discharge member 60 and arranged in the air jet cylinder 50 contained in the outer cylinder 10, at the rear end. By doing so, the air jet space 66 for jetting rotation air and the plurality of retractable support spaces 67 are formed by the arm members 65; in this case, the retractable support spaces 67 are opened in a direction perpendicular to the axial line. Thus, a rotational force is given to the discharge member 60 by the air jetted from the air jet port 53 of the air jet cylinder 50 arranged outside the air jet space 66. Further, the friction block 70 is movably contained in each retractable support space 67, and the outer surface 71 of each friction block 70 is abutted against the air jet cylinder 50 so that the rotational force is set to a predetermined value or less. By doing so, the rotational speed of the discharge member 60 for radially discharging the droplets 81 can be set to a proper value in a range from 800 to 6,000 rpm, e.g., 3,000 rpm. Of course, thermal spraying is carried out with respect to the inner surface of the pipes and the cylinder 91, and in addition, it is possible to protect the bearing 64 supporting the discharge member 60, and thus, to provide a thermal spraying torch having high durability.

What is claimed is:

1. A thermal spraying torch (100), successively supplying a thermal spray material (80) heated and fused by either a plasma forming gas by an arc generated between electrodes contained in an outer cylinder (10), or by a combustion gas supplied passing through the outer cylinder (10) and burned under high temperature state, and spraying the thermal spray material (80) via a nozzle (40) by the plasma forming gas or the combustion gas so that a droplet (81) can be formed, and further, including a rotatable discharge member (60), which is contained at a forward portion of the nozzle (40) and has a droplet passage (61) for the droplet (81) at the center so that the droplet (81) can be jetted together with the plasma forming gas or the combustion gas, characterized in that the discharge member (60) is formed with a projection (63), which changes a discharge direction of a droplet (81) at the center of a distal end portion, and is formed integrally with a plurality of arm members (65), which are projected from the discharge member (60) and arranged in an air jet cylinder (50) contained in the outer cylinder (10) at the rear end, thereby forming an air jet space (66) for jetting a rotation air, and a rotational force is given to the discharge member (60) by an air jetted from an air jet port (53) of the air jet cylinder (50) arranged outside the air jet space (66).

2. A thermal spraying torch (100), successively supplying a thermal spray material (80) heated and fused by either a plasma forming gas by an arc formed between electrodes contained in an outer cylinder (10), or by a combustion gas supplied passing through the outer cylinder (10) and burned under high temperature state, and spraying the thermal spray material (80) via a nozzle (40) by the forming gas or the combustion gas so that a droplet (81) can be formed, and further, including a rotatable discharge member (60), which is contained at a forward portion of the nozzle (40) and has a droplet passage (61) for the droplet (81) at the center so that the droplet (81) can be jetted together with the plasma forming gals or the combustion gas, characterized in that the discharge member (60) is formed with a projection (63), which changes a discharge direction of a droplet (81) at the center of a distal end portion, and is formed integrally with a plurality of arm members (65), which are projected from the discharge member (60) and arranged in an air jet cylinder (50) contained in the outer cylinder (10) at the rear end, thereby forming an air jet space (66) for jetting a rotation air and a plurality of retractable support spaces (67) opened in a direction perpendicular to the axial line, a rotational force is given o the discharge member (60) by an air jetted from an air jet port (53) of the air jet cylinder (50) arranged outside an air jet space (66), and a friction block (70) is movably contained in each retractable support space (67), and an outer surface (71) of each friction block (70) is abutted against the air jet cylinder (50) so that the rotational force is set to a predetermined value or less.

3. The thermal spraying torch according to claim 1, wherein said thermal spray material is formed sing said plasma forming gas, said discharge member (60) serving as a positive electrode an said nozzle (40) serving as a negative electrode.

4. The thermal spraying torch according to claim 2, wherein said thermal spray material is formed sing said plasma forming gas, said discharge member (60) serving as a positive electrode an said nozzle (40) serving as a negative electrode.

* * * * *